US009980534B2

(12) United States Patent
Beye et al.

(10) Patent No.: US 9,980,534 B2
(45) **Date of Patent: *May 29, 2018**

(54) SPACER TEXTILE MATERIAL WITH TENSILE STRANDS THAT INTERSECT

(71) Applicant: NIKE, Inc., Beaverton, OR (US)

(72) Inventors: Douglas A. Beye, Beaverton, OR (US); Lysandre Follet, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 180 days.

This patent is subject to a terminal disclaimer.

(21) Appl. No.: 14/968,348

(22) Filed: Dec. 14, 2015

(65) Prior Publication Data

US 2016/0095388 A1 Apr. 7, 2016

Related U.S. Application Data

(62) Division of application No. 13/741,435, filed on Jan. 15, 2013, now Pat. No. 9,241,537.

(51) Int. Cl.
*D04B 21/20* (2006.01)
*D04B 1/22* (2006.01)
(Continued)

(52) U.S. Cl.
CPC ..... *A43B 23/0205* (2013.01); *A43B 23/025* (2013.01); *A43B 23/0235* (2013.01); *A43B 23/0245* (2013.01); *A43B 23/0255* (2013.01); *A43C 1/04* (2013.01); *D04B 1/22* (2013.01); *D04B 21/20* (2013.01);
(Continued)

(58) Field of Classification Search
CPC .... B32B 5/06; B32B 5/10; B32B 5/22; A43B 1/04
USPC ..... 442/239, 240, 242–244, 246, 255, 305, 442/306, 312–314; 428/102, 103, 105, 428/107, 109, 110, 111, 114, 122, 123, 428/190
See application file for complete search history.

(56) References Cited

U.S. PATENT DOCUMENTS 4,333,978 A 6/1982 Kocher
4,705,586 A 11/1987 Pouget et al.
(Continued)

FOREIGN PATENT DOCUMENTS

EP 0212984 A2 3/1987
EP 0874076 A2 10/1998
(Continued)

OTHER PUBLICATIONS

International Preliminary Report on Patentability and Written Opinion dated Jul. 21, 2015 for International Patent Application No. PCT/US2014/011386.
(Continued)

*Primary Examiner* — Jenna L Johnson
(74) *Attorney, Agent, or Firm* — Klarquist Sparkman, LLP

(57) ABSTRACT

A spacer textile material has at least a portion of multiple tensile strands located between a first layer and a second layer of the spacer textile material where the first layer and second layer have been joined together to form channels in which the tensile strands move freely. In one or more locations, a first tensile strand and a second tensile overlap at an intersection region. Further, the spacer textile material may be incorporated into an article of footwear.

19 Claims, 11 Drawing Sheets

(51) Int. Cl.
*A43B 23/02* (2006.01)
*A43C 1/04* (2006.01)

(52) U.S. Cl.
CPC ..... *D10B 2403/021* (2013.01); *D10B 2403/02412* (2013.01); *D10B 2501/043* (2013.01); *Y10T 428/24174* (2015.01)

(56) References Cited

U.S. PATENT DOCUMENTS

| | | | | |
|---|---|---|---|---|
| 4,785,558 | A | 11/1988 | Shiomura et al. | |
| 4,863,776 | A | 9/1989 | Sternlieb | |
| 5,149,583 | A | 9/1992 | Saarikettu | |
| 5,475,904 | A | 12/1995 | Le Roy | |
| 5,601,907 | A | 2/1997 | Matsumoto | |
| 5,713,399 | A | 2/1998 | Collette et al. | |
| 6,052,921 | A | 4/2000 | Oreck | |
| 6,119,371 | A | 9/2000 | Goodwin et al. | |
| 6,533,885 | B2 | 3/2003 | Davis et al. | |
| 6,544,910 | B2 | 4/2003 | Himmelsbach et al. | |
| 6,835,257 | B2 | 12/2004 | Perrine | |
| 6,854,296 | B1 | 2/2005 | Miller, III | |
| 6,910,288 | B2 | 6/2005 | Dua | |
| 6,957,504 | B2 | 10/2005 | Morris | |
| 7,076,891 | B2 | 7/2006 | Goodwin | |
| 7,316,840 | B2 | 1/2008 | Neculescu et al. | |
| 7,479,195 | B2 | 1/2009 | Leidig et al. | |
| 7,568,298 | B2 * | 8/2009 | Kerns | 36/50.1 |
| 7,718,249 | B2 | 5/2010 | Russell et al. | |
| 7,776,171 | B2 | 8/2010 | Lehto et al. | |
| 7,824,513 | B2 | 11/2010 | Chernyak et al. | |
| 7,883,594 | B2 | 2/2011 | Albanese et al. | |
| 8,056,287 | B2 | 11/2011 | Demello | |
| 8,132,340 | B2 | 3/2012 | Meschter | |
| 8,266,827 | B2 | 9/2012 | Dojan et al. | |
| 8,312,645 | B2 | 11/2012 | Dojan et al. | |
| 8,312,646 | B2 | 11/2012 | Meschter et al. | |
| 8,800,172 | B2 | 8/2014 | Dua et al. | |
| 8,881,430 | B2 | 11/2014 | Seamarks et al. | |
| 8,887,410 | B2 | 11/2014 | Dojan et al. | |
| 8,893,405 | B2 | 11/2014 | Dojan et al. | |
| 9,132,601 | B2 | 9/2015 | Beye et al. | |
| 9,226,548 | B2 | 1/2016 | Follet et al. | |
| 9,241,537 | B2 | 1/2016 | Beye et al. | |
| 2003/0046843 | A1 | 3/2003 | Chien | |
| 2004/0181972 | A1 | 9/2004 | Csorba | |
| 2008/0110048 | A1 | 5/2008 | Dua et al. | |
| 2008/0110049 | A1 | 5/2008 | Sokolowski et al. | |
| 2010/0154256 | A1 | 6/2010 | Dua et al. | |
| 2010/0186874 | A1 | 7/2010 | Sussmann | |
| 2010/0192410 | A1 | 8/2010 | Marvin et al. | |
| 2010/0251564 | A1 * | 10/2010 | Meschter | 36/28 |
| 2010/0323148 | A1 | 12/2010 | Lafond et al. | |
| 2011/0192058 | A1 | 8/2011 | Beers et al. | |
| 2011/0192059 | A1 | 8/2011 | Spanks et al. | |
| 2012/0023778 | A1 | 2/2012 | Dojan et al. | |
| 2012/0198727 | A1 | 8/2012 | Long | |
| 2012/0233882 | A1 * | 9/2012 | Huffa et al. | 36/45 |
| 2013/0019500 | A1 | 1/2013 | Greene | |
| 2013/0145652 | A1 | 6/2013 | Podhajny et al. | |
| 2014/0068968 | A1 | 3/2014 | Podhajny et al. | |
| 2014/0196310 | A1 | 7/2014 | Beye et al. | |

FOREIGN PATENT DOCUMENTS

| | | | |
|---|---|---|---|
| EP | 1055757 | A1 | 11/2000 |
| EP | 1184499 | A1 | 3/2002 |
| EP | 1367913 | B1 | 2/2008 |
| WO | 9003744 | A1 | 4/1990 |
| WO | 2012015588 | A1 | 2/2012 |

OTHER PUBLICATIONS

International Preliminary Report on Patentability and Written Opinion dated Jul. 21, 2015 for International Patent Application No. PCT/US2014/011387.

International Preliminary Report on Patentability and Written Opinion dated Jul. 21, 2015 for International Patent Application No. PCT/US2014/011389.

International Preliminary Report on Patentability and Written Opinion dated Jul. 21, 2015 for International Patent Application No. PCT/US2014/011392.

International Search Report and Written Opinion dated Jul. 4, 2014 for International Patent Application No. PCT/US2014/011386.

International Search Report and Written Opinion dated Jun. 30, 2014 for International Patent Application No. PCT/US2014/011387.

International Search Report and Written Opinion dated Jul. 15, 2014 for International Patent Application No. PCT/US2014/011389.

International Search Report and Written Opinion dated Nov. 6, 2014 for International Patent Application No. PCT/US2014/011392.

* cited by examiner

SPACER TEXTILE MATERIAL WITH TENSILE STRANDS THAT INTERSECT

CROSS-REFERENCE TO RELATED APPLICATIONS

This application is a divisional of U.S. Patent Publication Number 2014/0196315, now U.S. patent application Ser. No. 13/741,425, filed Jan. 15, 2013 and titled "Spacer Textile Material With Tensile Strands That Intersect," the entirety of which is herein incorporated by reference.

RELATED APPLICATIONS

This application is related to the following commonly owned applications: Follett, U.S. Pat. No. 9,095,186, issued Aug. 4, 2015, entitled "Article of Footwear Incorporating Braided Tensile Strands"; Beye et al., U.S. Pat. No. 9,132,601, issued Sep. 15, 2015, entitled "Spacer Textile Material With Tensile Strands Having Multiple Entry and Exit Points"; Beye et al., U.S. Patent Application Publication Number 2014/0196310 published Jul. 17, 2014, now U.S. patent application Ser. No. 13/741,433, filed Jan. 15, 2013, and entitled "Spacer Textile Material with Tensile Strands in Non-Linear Arrangements"; and Follett et al., U.S. Patent Application Publication Number 2014/0196311 published Jul. 17, 2014, now U.S. patent application Ser. No. 13/741,440, filed Jan. 15, 2013, and entitled "Spacer Textile Material with Channels Having Multiple Strands", which are all incorporated by reference herein in their entireties.

BACKGROUND

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter.

The various material elements forming the upper impart specific properties to different areas of the upper. For example, textile elements may provide breathability and may absorb moisture from the foot, foam layers may compress to impart comfort, and leather may impart durability and wear-resistance. As the number of material elements increases, the overall mass of the footwear may increase proportionally. The time and expense associated with transporting, stocking, cutting, and joining the material elements may also increase. Additionally, waste material from cutting and stitching processes may accumulate to a greater degree as the number of material elements incorporated into an upper increases. Moreover, products with a greater number of material elements may be more difficult to recycle than products formed from fewer material elements. By decreasing the number of material elements, therefore, the mass of the footwear and waste may be decreased, while increasing manufacturing efficiency and recyclability.

The sole structure is secured to a lower portion of the upper so as to be positioned between the foot and the ground. In athletic footwear, for example, the sole structure includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction. The sole structure may also include a sockliner positioned within the upper and proximal a lower surface of the foot to enhance footwear comfort.

SUMMARY

In one aspect, a spacer textile material includes a first layer, a second layer and a plurality of connecting members extending between and joining the first layer and the second layer. The spacer textile material also includes a first tensile strand and a second tensile strand, a first channel bounded by portions of the first layer and the second layer that are in direct contact and a second channel bounded by portions of the first layer and the second layer that are in direct contact. A portion of a first tensile strand is disposed between the first layer and the second layer in the first channel. A portion of a second tensile strand is disposed between the first layer and the second layer in the second channel. The first tensile strand intersects the second tensile strand at an intersection region.

In another aspect, a spacer textile material includes a first layer, a second layer and a plurality of connecting members extending between and joining the first layer and the second layer. The spacer textile material also includes a first tensile strand and a second tensile strand, a first channel bounded by portions of the first layer and the second layer that are in direct contact and a second channel bounded by portions of the first layer and the second layer that are in direct contact. A portion of the first tensile strand is disposed in the first channel and a portion of the second tensile strand is disposed in the second channel. The first tensile strand intersects the second tensile strand at a first intersection region and a second intersection region that is spaced apart from the first intersection region.

In another aspect, an article of footwear includes an upper and a sole structure, where at least a portion of the upper includes a spacer textile material. The spacer textile material includes a first layer, a second layer and a plurality of connecting members extending between and joining the first layer and the second layer. The spacer textile material also includes a first tensile strand and a second tensile strand. Portions of the first layer are joined to portions of the second layer to define a plurality channels. At least a portion of the first tensile strand and at least a portion of the second tensile strand are disposed between the first layer and second layer within the plurality of channels. The first tensile strand and the second tensile strand intersect in an intersection region.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the disclosure. Moreover, in the figures, like reference numerals designate corresponding parts throughout the different views.

DETAILED DESCRIPTION

Figure 1:
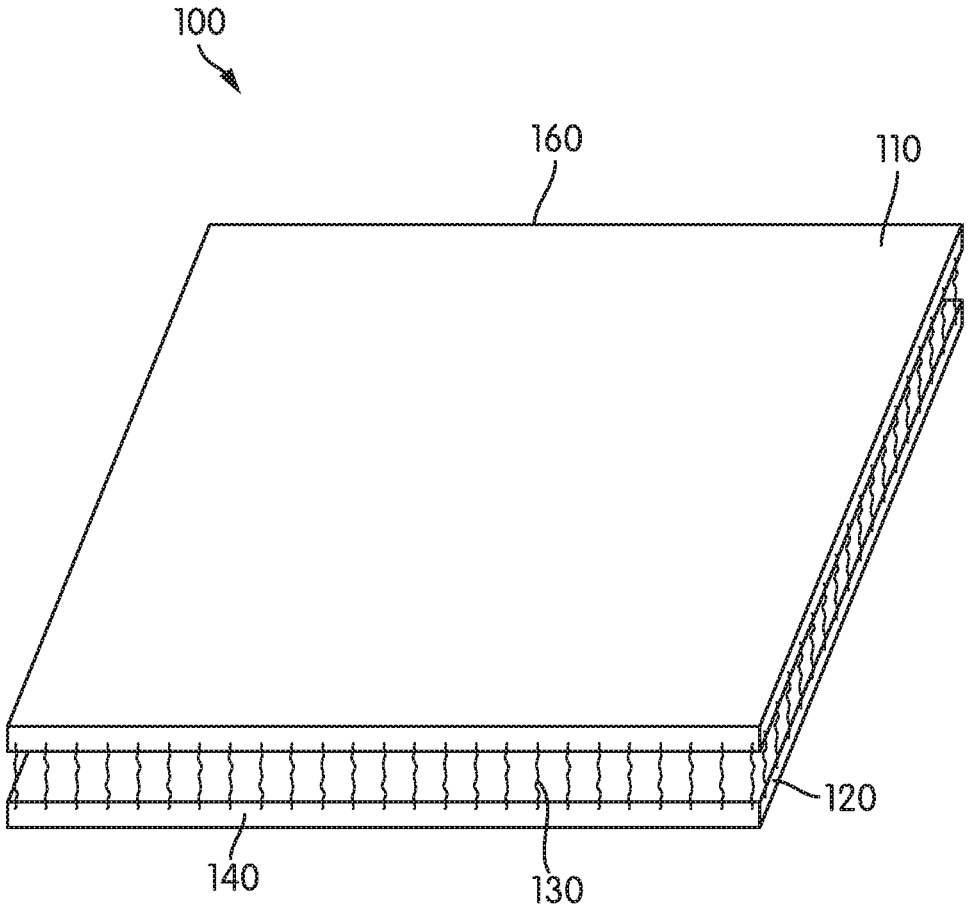
FIG. 1 shows an embodiment of the spacer textile material.

FIG. 1 illustrates an embodiment of a spacer textile material 100. In one embodiment, spacer textile material 100 may include a first layer 110, as well as a second layer 120 that is at least partially coextensive with first layer 110. In addition, spacer textile material 100 may have a plurality of connecting members 130 that extend between and join first layer 110 and second layer 120.

Connecting members 130 may be arranged to form a series of rows. The rows of connecting members 130 are separated by various spaces. In some embodiments, the rows formed by connecting members 130 may be substantially parallel to each other and distributed at substantially equal distances across spacer textile material 100. In other embodiments, the rows could be non-parallel and/or unevenly spaced apart. Spaces may be areas within spacer textile material 100 where connecting members 130 are absent. Typically, spaces may include areas between the rows formed by connecting members 130.

Spacer textile material 100 also may define at least a pair of opposite edges, first edge 140 and second edge 160, which are also edges of first layer 110 and second layer 120. In some embodiments, each of first edge 140 and second edge 160 may be substantially parallel to the rows formed by connecting members 130.

The spacer textile material may be formed by any suitable method for manufacturing such a material. A general process may include one or more yarns being fed into a conventional knitting apparatus. The knitting apparatus may mechanically manipulate yarns to form each of a first layer and a second layer. The knitting apparatus may also manipulate yarns to form connecting members between the first and second layers. As such, the first layer and second layer may be knitted layers, and the connecting members may be sections of at least one yarn that extend between the first layer and second layer. Moreover, the process forms spaces, edges, and stabilization structures.

Once formed, the spacer textile material exits the knitting apparatus and is collected on a roll. After a sufficient length of spacer textile material is collected, the roll may be shipped or otherwise transported to a manufacturer to utilize the spacer textile material for the manufacture of footwear or for any other purposes. Although not always performed, the spacer textile material may be subjected to various finishing operations (e.g., dying, fleecing) prior to being collected on a roll.

Examples of spacer textile material and methods of making spacer textile material are disclosed in any of the following: Chao et al., U.S. Patent Publication Number 2013/0266773, entitled, "Spacer Textile Materials and Methods for Manufacturing the Spacer Textile Materials," published on Oct. 10, 2013; Goodwin et al., U.S. Pat. No. 6,119,371, entitled "Resilient Bladder for Use in Footwear," issued on Sep. 19, 2000; and Goodwin, U.S. Pat. No. 7,076,891, entitled "Flexible Fluid-Filled Bladder for an Article of Footwear," issued on Jul. 18, 2006, the entirety of each being incorporated by reference.

Some embodiments of a spacer textile material may include a tensile strand. In some embodiments, one or more portions of the tensile strand may be located between the first layer and the second layer. In some embodiments, one or more portions of the tensile strand may be disposed in channels that may be created by joining a first layer and second layer of the spacer textile material. After assembly, the tensile strand may move freely within the one or more channels.

Figure 2:
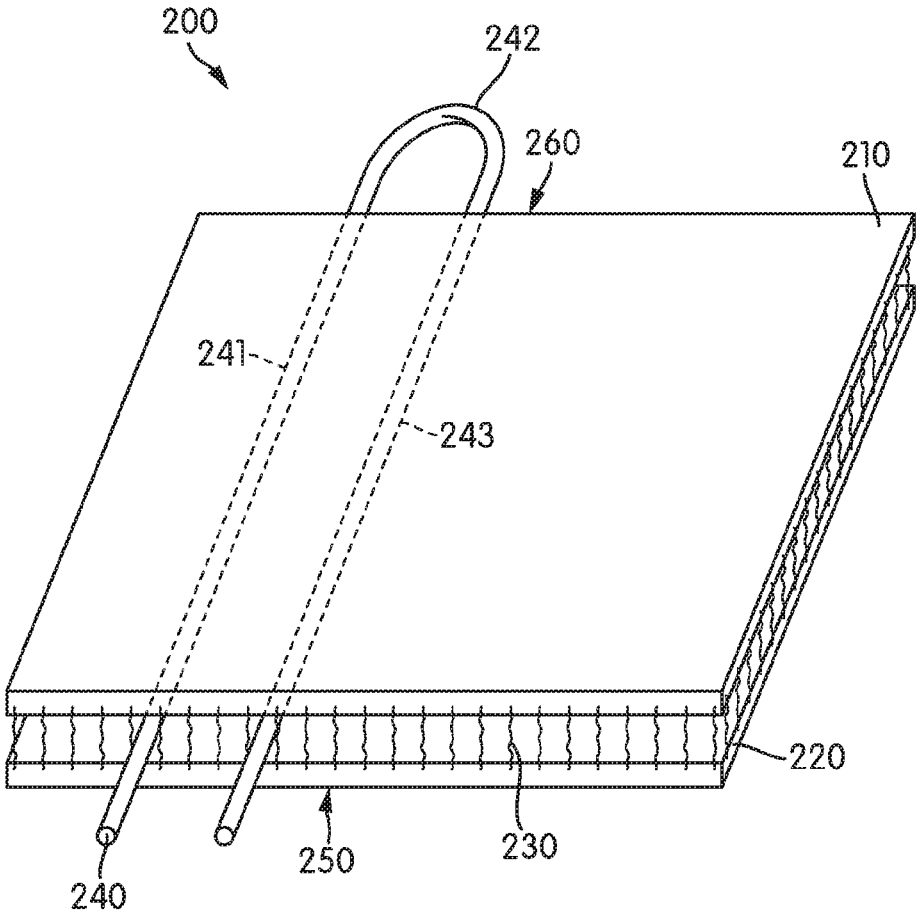
FIG. 2 shows an embodiment of the spacer textile material having a tensile strand disposed between a first layer and a second layer.

As discussed above, the spacer textile material may include at least one tensile strand. The tensile strand may be located in any portion of the spacer textile material. FIG. 2 shows an embodiment of a spacer textile material 200. Spacer textile material 200 may include tensile strand 240. Further, spacer textile material 200 may include a plurality of connecting members 230 that extend between and join first layer 210 and second layer 220. Connecting members 230 may be arranged to form a series of rows that are separated by various spaces. A portion of tensile strand 240 may be disposed between first layer 210 and second layer 220. In particular, tensile strand 240 may be disposed in the space created between connecting members 230.

Spacer textile material 200 also defines at least a pair of opposite edges, first edge 250 and second edge 260. First edge 250 and second edge 260 also may be edges of first layer 210 and second layer 220. In some embodiments, each of first edge 250 and second edge 260 may be substantially parallel to the rows formed by connecting members 230. However, in other embodiment, first edge 250 and/or second edge 260 may not be parallel with the rows formed by connecting members 230.

In different embodiments, the arrangement of a tensile strand within a spacer textile material can vary. For example, various portions of a tensile strand may extend through spacer textile material (i.e., between a first layer and a second layer) in parallel with, or at various angles to, one or more edges of the spacer textile material. Additionally, in some embodiments, different portions or segments of a tensile strand may be aligned in parallel with one another. In other embodiments, different portions or segments of a tensile strand could be disposed at various angles to one another.

An exemplary arrangement of a tensile strand within a spacer textile material is shown in FIG. 2. In the embodiment shown in FIG. 2, a first portion 241 of tensile strand 240 may be disposed between first layer 210 and second layer 220 of spacer textile material 200. Moreover, first portion 241 may generally extend from first edge 250 to second edge 260. In addition, a third portion 243 of tensile strand 240 may also be disposed between first layer 210 and second layer 220 of spacer textile material 200 and may likewise extend between first edge 250 and second edge 260. Furthermore, a second portion 242 of tensile strand 240 may be disposed between first portion 241 and third portion 243. In contrast to first portion 241 and third portion 243, which may be disposed between adjacent layers of spacer textile material 200, second portion 242 may extend outwardly from second edge 260 such that second portion 242 is not disposed between first layer 210 and second layer 220. In some embodiments, second portion 242 forms a loop that extends from second edge 260 of spacer textile material 200.

As one exemplary arrangement, first portion 241 and third portion 243 are shown extending in parallel between first edge 250 and second edge 260. Moreover, first portion 241 and third portion 243 may be oriented in a direction that is approximately perpendicular to first edge 250 and second edge 260. However, as previously discussed, in other embodiments one or more portions could vary in their orientations relative to other portions of a tensile strand and/or could vary in their orientations relative to edges of a spacer textile material.

The tensile strands of the disclosure may be formed from any generally one-dimensional material. As utilized with respect to the present disclosure, the term "one-dimensional material" or variants thereof is intended to encompass generally elongate materials exhibiting a length that is substantially greater than a width and a thickness.

The tensile strands of the disclosure may be formed from any suitable material. Accordingly, suitable materials for a tensile strand, for example tensile strand 240 of FIG. 2, may include various filaments, fibers, yarns, threads, cables, cords, or ropes. Suitable material for a tensile strand may be formed from or include rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, steel, and various combination of these kinds of materials.

Filaments have an indefinite length and in some cases a single filament can be utilized as a tensile strand, such as tensile strand 240. Fibers have a relatively short length and generally go through spinning or twisting processes to produce a strand of suitable length. An individual filament utilized in a tensile strand may be formed from a single material (i.e., a monocomponent filament) or from multiple materials (i.e., a bicomponent filament). Similarly, different filaments may be formed from different materials. As an example, yarns utilized as tensile strand 240 may include filaments that may be formed from a common material, or may include filaments that may be formed from two or more different materials. Similar concepts also apply to threads, cables, or ropes.

The spacer textile material of the disclosure may include two or more tensile strands. In some embodiments, when the spacer textile material includes multiple tensile strands, the tensile strands may be made from the same material. In some embodiments, the tensile strands may be made from different materials. When the tensile strands are made from different materials, the tensile strands may include different characteristics. For example, a first tensile strand may stretch when a force is applied. In some embodiments, a second tensile strand may stretch less than first tensile strand. In other embodiments, a second tensile strand may stretch more than the first tensile strand.

In some embodiments, the thickness of tensile strands may also vary significantly to range from less than 0.03 millimeters to more than 5 millimeters, for example. Although one-dimensional materials will often have a cross-section where the width and the thickness are substantially equal (e.g., a round or square cross-section), some one-dimensional materials may have a width that is greater than a thickness (e.g., a rectangular, oval, or otherwise elongate cross-section). Despite the greater width, a material may be considered one-dimensional if the length of the material is substantially greater than the width and the thickness of the material.

In some embodiments having multiple tensile strands, the thickness of each strand may be the same. In other embodiments, the thickness of each tensile strand may be different. The relative thickness of two or more tensile strands may be selected according to various factors including desired strength, elasticity, manufacturing considerations as well as possible other factors.

Examples of suitable tensile strands are disclosed in any of the following: Dojan et al., U.S. Pat. No. 8,925,129, entitled, "Methods of Manufacturing Articles of Footwear With Tensile Strand Elements," issued Jan. 6, 2015; Dojan et al., U.S. Pat. No. 8,819,963, entitled, "Articles of Footwear With Tensile Strand Elements," issued Sep. 2, 2014; and Dojan et al., U.S. Pat. No. 8,973,288, entitled "Footwear Incorporating Angled Tensile Strand Elements," issued Mar. 10, 2015, the entirety of each being hereby incorporated by reference.

A tensile strand can be configured in any pattern, configuration or arrangement in a spacer textile material. In some embodiments, a tensile strand can be confined to a particular region of a spacer textile material. In other embodiments, a tensile strand may be associated with multiple different regions of a spacer textile material, including the entirety of the spacer textile material. Moreover, a tensile strand can extend through a spacer textile material (i.e., between adjacent layers), as well as outside of the layers that form the spacer textile material. In some embodiments, portions of a tensile strand may extend along an outer surface or outer face of a layer. In still other embodiments, portions of a tensile strand could extend along an edge of a spacer textile material.

For purposes of this disclosure, the term "opening" may include a space along an edge of the spacer textile material between a first layer and a second layer that is also between connecting members of the spacer textile material. Further, the term "opening" may include a space between the knitted strands of the first layer or second layer of the spacer textile. Further, the term "opening" may include a space, slit or hole in the first layer or second layer created during the preparation of the spacer textile material. As stated above, the tensile strand may be disposed through any opening on the spacer textile material.

The figures of this disclosure may show the ends of each tensile strand extending beyond the edges or faces of one or more layers of the spacer textile material. However, the ends of each tensile strand may be finished in any suitable manner. For example, in some embodiments, the tensile strand ends may extend beyond the edge of the spacer material. In such an embodiment, the ends of the tensile strand may extend into a second material or structure. Further, the ends of the tensile strand may be knotted or tied off so that the ends may not recess into the spacer textile material. Further, the ends may extend into the spacer textile material in a second direction and continue to extend throughout the material in a selected manner or pattern. In other embodiments, the ends of the tensile strand may be flush with the edge of the spacer textile material. Still further, the end of the tensile strand may be joined to the edge of one or more layers of the spacer textile material.

In addition to a tensile strand, the spacer textile material may include provisions for restricting the movement of the tensile strand within the spacer textile material. In some embodiments, a spacer textile material can include provisions for restricting the movement of one portion of the tensile strand. In other embodiments, a spacer textile material can include provisions for restricting two or more portions of a tensile strand (for example, two adjacent sides or ends of a tensile strand). In some embodiments, a spacer textile material can include one or more channels that act to restrict or restrain the movement various portions of the tensile strand. For example, a tensile strand disposed inside a channel of a spacer textile material may move freely in a longitudinal direction of the channel, while motion of the tensile strand in the lateral direction of the channel may be restricted.

Figure 5:
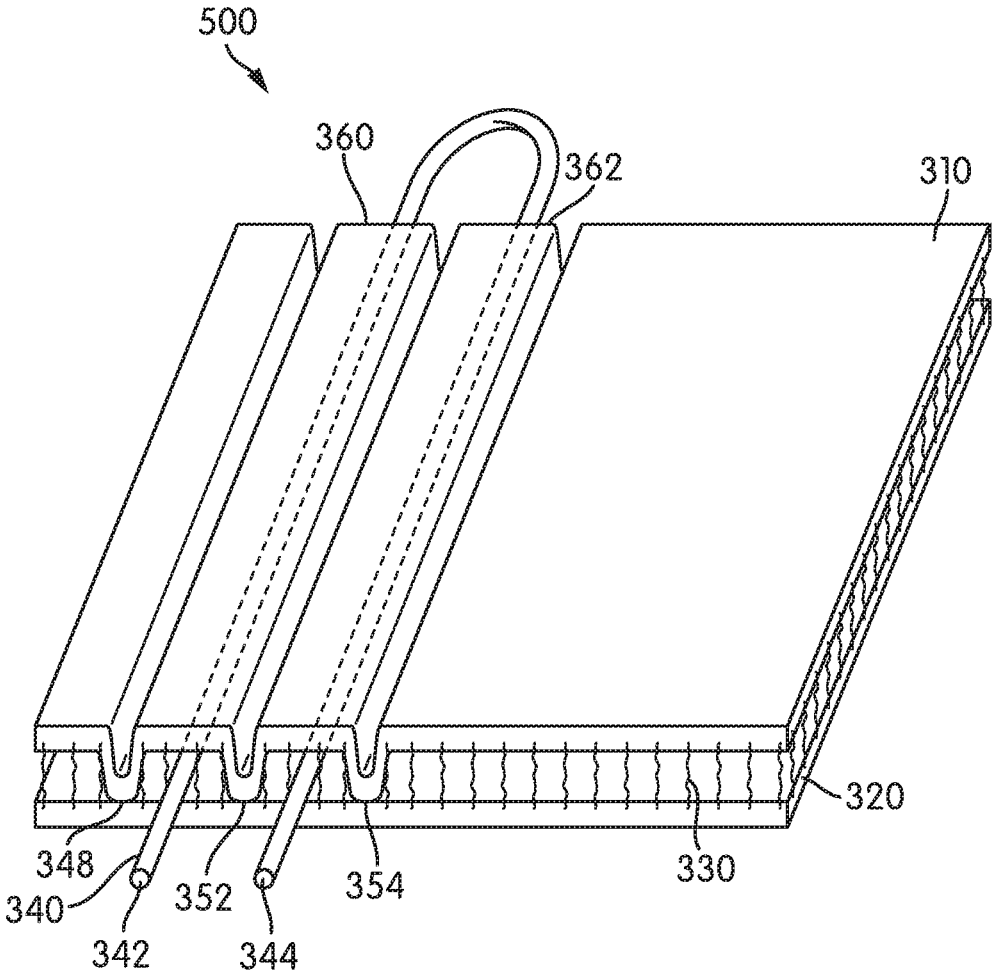
FIG. 5 is a schematic diagram of an embodiment of the spacer textile material having a tensile strand disposed in channels defined by one or more welds created through a welding method.

For instance, FIG. 5, which is discussed below is further detail, depicts spacer textile material 500 having portions of a tensile strand disposed within spacer textile material 500. Portions of a tensile strand may be further disposed in two channels, first channel 360 and second channel 362. As shown in FIG. 5, the tensile strand portions may be restricted in the lateral direction on both sides while the tensile strand portions are free to move within each channel in the longitudinal direction.

The channels formed in the spacer textile material may have any width. In some embodiments the width of the channel may accommodate one tensile strand. In other embodiments, the width of the channel may be large enough to accommodate two or more tensile strands. In addition, a first channel may have one width and a second channel may have a second width. The widths of multiple channels may be the same or the widths may be different. Further, the width of a single channel may change over the run of the channel. In other words, the width of the channel may vary throughout the length of the channel. For example, a channel may have a width that increases from a first edge to a second edge of a spacer textile material.

In some embodiments, channels of a spacer textile material may be bounded by portions of the first layer and the second layer that are in direct contact. In some embodiments, sections of the first layer and the second layer may be joined or fused to form one or more channels. The first layer may be joined to the second layer by any suitable method of joining such layers. In some embodiments, the first layer is joined to the second layer through a welding method. However, in other embodiments, the joining of the first layer and the second layer could be accomplished using other methods including, but not limited to: stitching, adhesives as well as other joining methods.

In some embodiments, the first layer and the second layer could be joined in a manner that forms one or more channels for guiding and controlling the configuration and possible motions of a tensile strand. For example, in some embodiments one or more welds could be used to join the first layer and the second layer such that adjacent welds form the walls of one or more channels.

In some embodiments, welding methods may be utilized to join the first layer to the second layer. The welding method utilized to join the first layer to the second layer may include a high frequency welding method. In some embodiments, the high frequency welding method may include an ultrasonic welding method or a radio frequency welding method.

In those embodiments that include ultrasonic welding methods, an ultrasonic welding device is used to join the first layer to the second layer of the spacer textile material. Ultrasonic welding devices utilize high frequency ultrasonic acoustic vibrations. The vibrations may be applied locally to a portion of the spacer textile material. Further, the vibrations applied to the spacer textile material cause friction. The friction softens the spacer textile material to fuse the first layer to the second layer. The fusion of the first layer to the second layer may be considered a solid state weld.

Examples of ultrasonic techniques and equipment are disclosed in any of the following: Albanese et al., U.S. Pat. No. 7,883,594, entitled "Wrapped pile weatherstripping and methods of making same," issued on Feb. 8, 2011; Chernyak, U.S. Pat. No. 7,824,513, entitled "Apparatus and method for making pile articles and improved pile articles made therewith," issued on Nov. 2, 2010; Lehto et al., U.S. Pat. No. 7,776,171, entitled "Arrangement and method for treatment of a material by means of an ultrasonic device," issued on Aug. 17, 2010; Perrine, U.S. Pat. No. 6,835,257, entitled "Ultrasonic weld pattern for adsorbent containing package" issued on Dec. 28, 2004; and Collette et al., U.S. Pat. No. 5,713,399, entitled "Ultrasonic seaming of abutting strips for paper machine clothing" issued on Feb. 3, 1998; the entirety of each being hereby incorporated by reference. One or more of the principles, concepts or methods disclosed in the cited references above may be implemented for preparing the welds on the spacer textile material of this disclosure.

Figure 3:
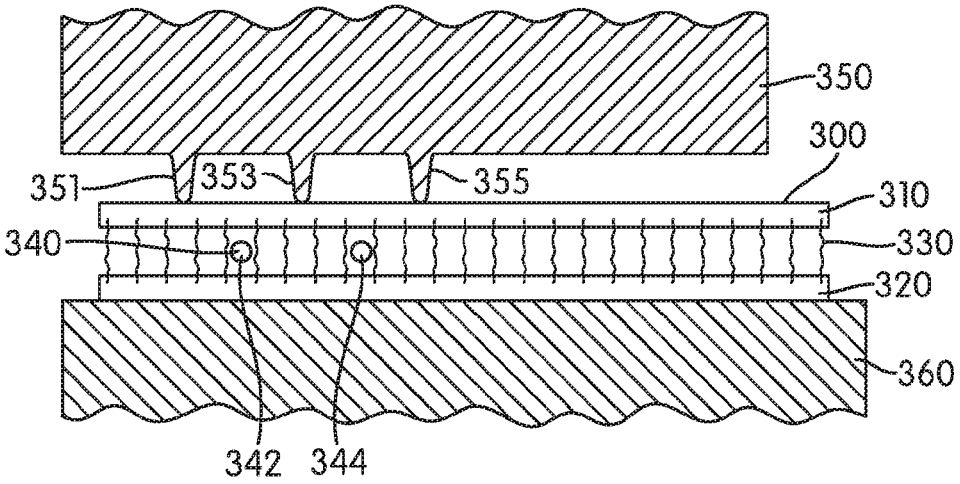
FIG. 3 is a schematic diagram of an embodiment of the spacer textile material having a tensile strand in a welding device prior to the joining of the first layer and second layer.

FIG. 3 shows an embodiment of spacer textile material 300 in a welding device. Spacer textile material 300 may include first layer 310, second layer 320 and connecting members 330. Spacer textile material 300 may further include a tensile strand 340 with first end 342 and second end 344. Tensile strand 340 may be located between first layer 310 and second layer 320.

In order to fuse portions of first layer 310 and second layer 320 together, spacer textile material 300 having tensile strand 340 may be positioned between a horn 350 and an anvil 360 of the welding device. As seen in FIG. 3, horn 350 may have a one or more protrusions. In some embodiments, horn 350 may have first protrusion 351, second protrusion 353, and third protrusion 355.

Each protrusion may form a pattern that is to be welded into the spacer textile material. The protrusions may form any suitable pattern. The patterns formed by one or more protrusions may include a stripe or line, parallel stripes or lines, perpendicular stripes or lines, a zig-zag pattern, a triangular pattern, and a wavy pattern, among other patterns.

For purposes of illustration, horn 350 and anvil 360 are shown schematically in the embodiments. Generally, the anvil 360 is a fixed component where the material to be welded rests or is nested. The horn 350 may be a sonotrode, which is connected to a transducer (not shown). The transducer causes the horn 350 to resonate or emit an acoustic vibration. In some embodiments, the frequency at which a horn vibrates may be between about 15 kHz and 85 kHz. Some examples of typical frequencies at which a horn vibrates include 15 kHz, 20 kHz, 30 kHz, 35 kHz, 40 kHz, and 70 kHz. The frequency chosen may depend on the material being welded as well as possibly other factors.

Horn 350 and anvil 360 come together under pressure to join a first material to a second material. In the embodiments shown in FIGS. 3 and 4, a first layer 310 is joined to a second layer 320 of spacer textile material 300. First layer 310 may be joined to second layer 320 in the location in which the material comes in contact with one or more of the protrusions, including first protrusion 351, second protrusion 353, and third protrusion 355, of horn 350.

Figure 4:
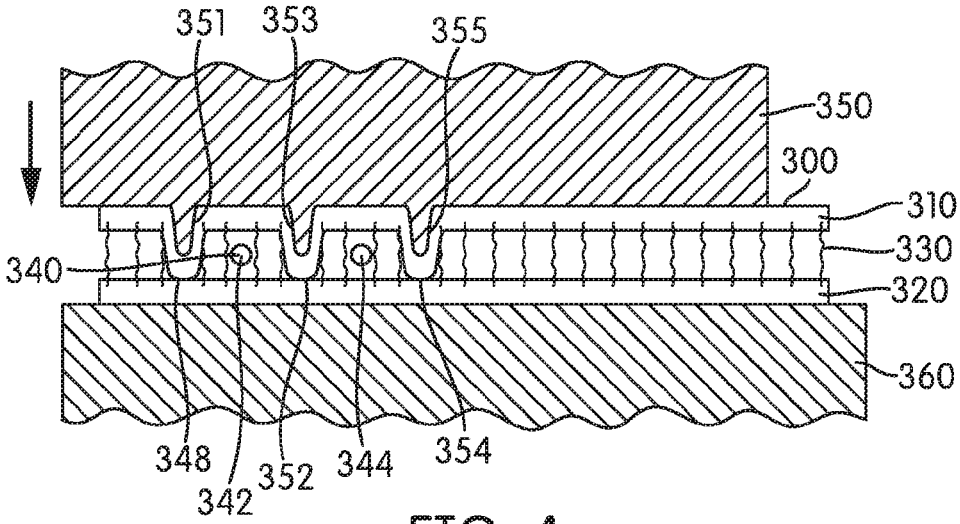
FIG. 4 is a schematic diagram of an embodiment of a welding device joining of the first layer and second layer of a spacer textile material having a tensile strand disposed between a first layer and a second layer.

FIG. 4 provides a schematic of an embodiment of an ultrasonic welding method. In FIG. 4, first protrusion 351, second protrusion 353 and third protrusion 355 of horn 350 cause first layer 310 to meet second layer 320 at first weld 348, second weld 352 and third weld 354. The transducer may be activated to cause horn 350 to resonate at a selected frequency. The vibrations of horn 350 generate friction between first layer 310 and second layer 320 of spacer textile material 300 and horn 350. The friction causes the materials of first layer 310 and second layer 320 to soften or melt. First layer 310 and second layer 320 may be allowed to cool to cause the layers to fuse to each other. Following this joining process, first layer 310 and second layer 320 may be fused or welded in those areas contacted by horn 350.

FIG. 5 depicts an embodiment of the welded spacer textile material 500. As can be seen, first weld 348, second weld 352 and third weld 354 may be generated by a welding device, as shown in FIG. 4. At each weld, first layer 310 may be fused to second layer 320. Further, first weld 348, second weld 352, and third weld 354 define two channels, first channel 360 and second channel 362. Both channels include portions of tensile strand 340. Tensile strand 340 is free to move in a longitudinal direction within the channels. However, the welds on both sides of tensile strand 340 restrain the lateral movement of tensile strand 340 within each channel of the spacer textile material 500.

In some embodiments, the welded spacer textile material, or a portion of the welded spacer textile material, may be incorporated into footwear, for example, as shown in FIG. 14, discussed below in further detail. In some cases, the spacer textile material may be configured for use in a wide range of athletic footwear styles, including running shoes, basketball shoes, cross-training shoes, football shoes, golf shoes, hiking shoes and boots, ski and snowboarding boots, soccer shoes, tennis shoes, and walking shoes, for example. Concepts associated with the spacer textile material may also be utilized with footwear styles that are generally considered to be primarily non-athletic, including dress shoes, loafers, sandals, casual shoes, clogs, flats, heels, pumps, wedges, and work boots.

In addition to footwear, the spacer textile material may be incorporated into other types of apparel and athletic equipment, including helmets, gloves, and protective padding for sports, such as football and hockey. Similar material may also be incorporated into cushions and other compressible structures utilized in household goods and industrial products.

Additionally, the discussion and figures disclose various configurations of a spacer textile material. Although portions of the spacer textile material are disclosed as being incorporated into footwear, the spacer textile material may be utilized with a variety of other products or for a variety of other purposes. In some embodiments, the spacer textile material may be utilized in apparel, such shirts, shorts, pants, outerwear, sports uniforms/jerseys, hats, socks, and undergarments, among other pieces of apparel.

The welding method described above is not restricted to the patterns described in this disclosure. The welding device may be configured to prepare a spacer textile material with a wide variety of patterns and textures.

The spacer textile material may be formed from any suitable material. In some embodiments, the material used in making a spacer textile material may be suitable for the joining method utilized to join the first layer to the second layer of the spacer textile material.

In those embodiments where an ultrasonic welding method is utilized to join the first layer and second layer of the spacer textile material, the spacer textile material may be made of any material suitable for such a spacer textile configuration. Further, the spacer textile material may be made of any material suitable for high frequency welding methods. Materials suitable for high frequency welding include thermoplastic material or natural material coated with a thermoplastic material. Examples of material suitable for high frequency welding methods include an acrylic, a nylon, a polyester, a polylactic acid, a polyethylene, a polypropylene, polyvinyl chloride (PVC), an urethane, a natural fiber, such as cotton or wool, that is coated with one or more thermoplastic materials, such as an ethyl vinyl acetate or thermoplastic polyurethane, and combinations thereof.

In some embodiments, the first layer and the second layer of a spacer textile material may be made of the same material or combination of materials. In other embodiments, the first layer may be made of one suitable material or combination of materials, and the second layer may be made of a second suitable material or combination of materials that are different from the first layer.

Further, the connecting members of the spacer textile material may be made of any suitable material. In some embodiments, the material of the connecting member may be the same as the material of the first layer. In other embodiments, the material of the connecting members may be the same as the material of the second layer. In still further embodiments, the material of the connecting members may be substantially different than both the material of the first layer and the material of the second layer.

Other welding methods may be utilized to join layers of a spacer textile material. For example, in some embodiments a radio frequency (RF) welding method could be used. In some embodiments, radio frequency welding could be used with a hot melt adhesive. In some cases, the use of a hot melt adhesive may enhance the application of RF welding to a low mass spacer textile material.

Welding methods could also be used with a variety of different materials. In some embodiments, materials having desired channel geometry can be achieved by selecting a combination of a welding method and a suitable material or materials. For example, some embodiments could use thermoplastic polyurethane (TPU) in combination with ultrasonic welding to achieve the desired channel geometry on a portion of an upper or other section of an article.

Still other methods are possible for joining layers of a spacer textile material. As one example, in other embodiments, the first layer may be joined to the second layer by a thermal fusion method. The thermal fusion method may include heat bonding. Heat bonding methods include hot die heating, steam heating or hot air heating.

In further embodiments, the first layer may be joined to the second layer through stitching methods or weaving methods. In some embodiments, where the layers are joined through stitching methods, the material used to form the stitch may be the same as the material of the first layer or second layer. In other embodiments, the materials used to form the stitch may be a different material from both the first layer and the second layer of the spacer textile material.

It will be understood that the embodiments are not limited to any particular method for forming channels in a spacer textile material. In particular, the embodiments depict various configurations of a spacer textile material that allows for tensile strands (such as wires) to be captured and guided through various channels. Although the following embodiments may reference welding or welds used to join regions of layers in a spacer textile material, it should be understood that in other embodiments the regions of joined material could be created using stitching, gluing, as well as possibly other methods.

One or more tensile strands and/or associated channels could be arranged in a variety of configurations within a spacer textile material. As stated above, portions of the tensile strand may enter or exit the spacer textile material at any point on the material. Further, the tensile strands, and channels in which the tensile strands are disposed, may be arranged in any pattern including, but not limited to: linear patterns, non-linear patterns, regular patterns, irregular patterns as well as any other patterns.

Some embodiments can include provisions for applying tension in a variety of different directions across a spacer textile material. In order to accommodate multiple tensile strands that extend through a spacer textile material in a variety of different directions, some embodiments may include two or more tensile strands that intersect, or otherwise overlap, one another.

In some embodiments, two or more tensile strands may intersect in at least one region of a spacer textile material. The term "intersection region" as used throughout this detailed description and in the claims refers to any region where two or more tensile strands intersect, or otherwise overlap. In some embodiments, two tensile strands may contact one another at the intersection region. Such an intersection could occur, for example, at a single intersection point. In other embodiments, however, two tensile strands may be spaced apart at the intersection region. For example, in some embodiments discussed below, one tensile strand may extend through a channel within a spacer textile material and may be intersected, or overlapped, by a second tensile material that extends along an outer surface of the spacer textile material and crosses over the path of the first tensile material. In other words, the term intersection region is not limited to cases where two or more tensile strands physically contact one another, and may be used to characterize situations where one tensile strand crosses above (or below) an adjacent tensile strand.

FIGS. 6 through 12 illustrate various different configurations or arrangements of one or more tensile strands in a spacer textile material. It will be understood that the following configurations are only intended to be exemplary and still other configurations may be possible in other embodiments. Moreover, features of the different embodiments may be combined to create still further arrangements for one or more tensile strands within a spacer textile material.

For purposes of convenience, the term "plurality of tensile strands" is used throughout this detailed description and in the claims to refer to any collection of two or more tensile strands. Likewise, the term "plurality of welds" refers to any collection of two or more welds on a spacer textile material. Still further, the term "plurality of channels" refers to any collection of two or more channels formed in a spacer textile material.

Figure 6:
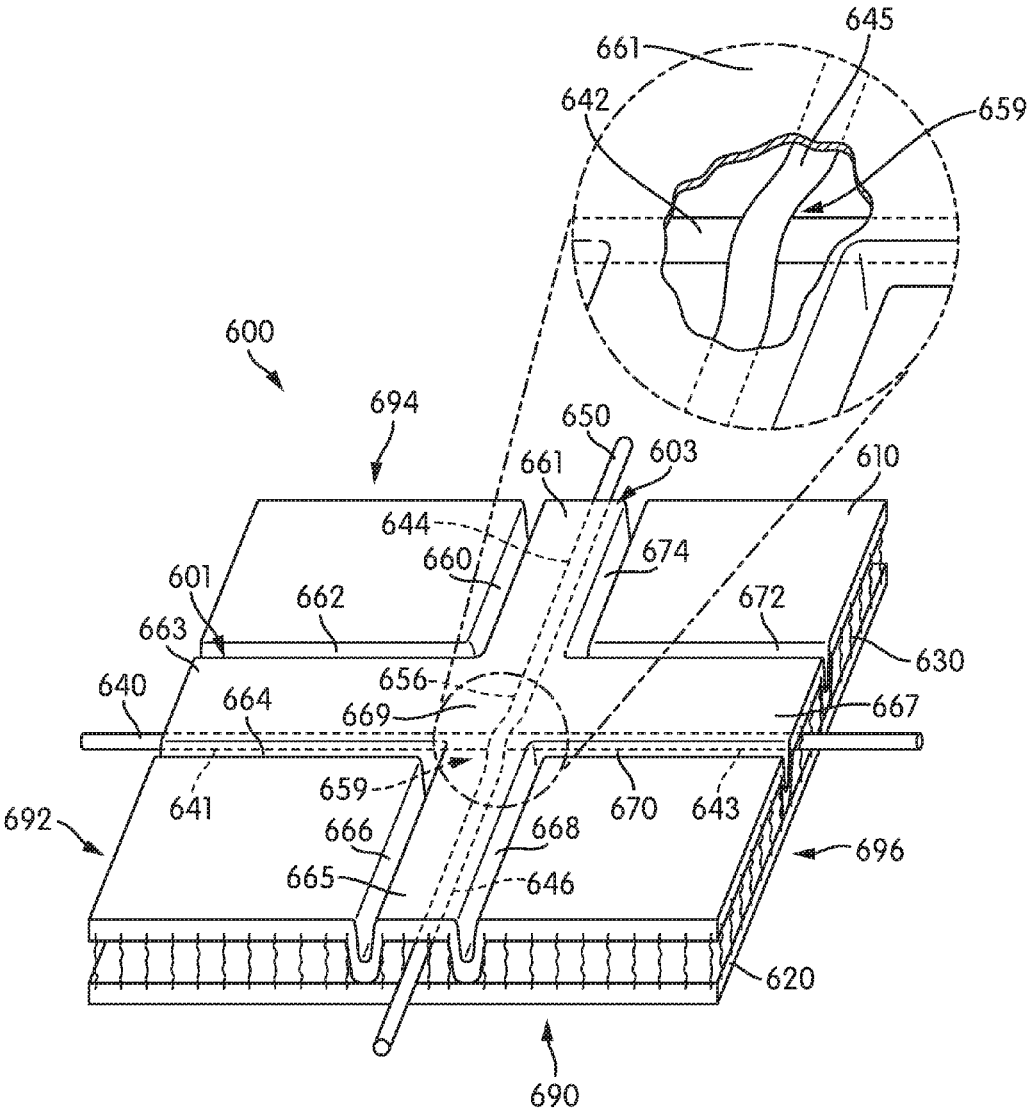
FIG. 6 is a schematic diagram of an embodiment of the spacer textile material having two tensile strands where the tensile strands intersect between the first layer and second layer of the spacer textile material.

FIG. 6 illustrates an embodiment of a spacer textile material having two intersecting, or overlapping, tensile strands. First tensile strand 640 and second tensile strand 650 may be disposed between first layer 610 and second layer 620 of a spacer textile material 600. Further, spacer textile material 600 may include a plurality of connecting members 630 that extend between and join first layer 610 and second layer 620. Spacer textile material 600 also may have four edges, first edge 690, second edge 692, third edge 694 and fourth edge 696, which are also edges of first layer 610 and second layer 620.

Spacer textile material 600 includes a plurality of channels for receiving first tensile strand 640 and second tensile strand 650. In particular, spacer textile material 600 includes first channel 601, which extends from second edge 692 to fourth edge 696. Additionally, spacer textile material 600 includes second channel 603, which extends from first edge 690 to third edge 694. First channel 601 and second channel 603 may comprise various portions that intersect, or are joined together, at connecting portion 669. In particular, first channel 601 includes first portion 663 and second portion 667 that intersect first portion 661 and second portion 665 of second channel 603 at connecting portion 669.

In some embodiments, the different portions of each channel are formed and bounded by various welds. For example, first portion 663 of first channel 601 is associated with first weld 662 and second weld 664. Second portion 667 of first channel 601 is associated with third weld 670 and fourth weld 672. In addition, first portion 661 of second channel 603 is associated with fifth weld 660 and sixth weld 674, while second portion 665 of second channel 603 is associated with eighth weld 666 and ninth weld 668.

In the embodiment shown in FIG. 6, this plurality of welds is formed such that first channel 601 and second channel 603 are approximately perpendicular with one another. However, in other embodiments first channel 601 and second channel 603 may be intersect at any angle. Moreover, in some other embodiments first channel 601 and/or second channel 603 may not be straight. In other words, in other embodiments, any angle may be formed between adjacent portions of the channels (for example, between first portion 663 of first channel 601 and first portion 661 of second channel 603).

In some embodiments, first tensile strand 640 and second tensile strand 650 may intersect at an intersection region 659. In some embodiments, the intersection region 659 may be further associated with connecting portion 669 where first channel 601 and second channel 603 are joined. In particular, first tensile strand 640 includes a first portion 641, a second portion 642 and a third portion 643 associated with first portion 663 of first channel 601, connecting portion 669 and second portion 667 of first channel 601, respectively. Likewise, second tensile strand 650 includes a first portion 644, a second portion 645 and a third portion 646 associated with first portion 661 of second channel 603, connecting portion 669 and second portion 665 of second channel 603, respectively. Thus, it is to be understood that second portion 642 of first tensile strand 640 and second portion 645 of second tensile strand 650 intersect within connecting portion 669. In some embodiments, first tensile strand 640 and second tensile strand 650 may both be disposed between first layer 610 and second layer 620 at intersection region 659. Moreover, in this configuration second tensile strand 650 may be disposed over first tensile strand 640. In some cases, second tensile strand 650 physically contacts first tensile strand 640.

With this arrangement, first tensile strand 640 and second tensile strand 650 may be used to apply tension in different directions over a substantially large area or region of spacer textile material 600. Moreover, as discussed in more detail below, such intersections between different tensile strands may allow for the creation of support structures formed by overlapping multiple tensile strands in a variety of patterns. Exemplary patterns that may be used include, but are not limited to: lattice or grid-like patterns, truss-like patterns as well as a variety of other patterns that may be used to tune the structural properties of a spacer textile material.

In other embodiments having an intersection between two tensile strands, one tensile strand may exit the spacer textile material and reenter the spacer textile material in the vicinity of the intersection region. Further, in some embodiments, the portion of the tensile strand disposed on the exterior of the spacer textile material may interact with other portions or components of the spacer textile material, such as a lace or other fastening component used to adjust tension.

Figure 7:
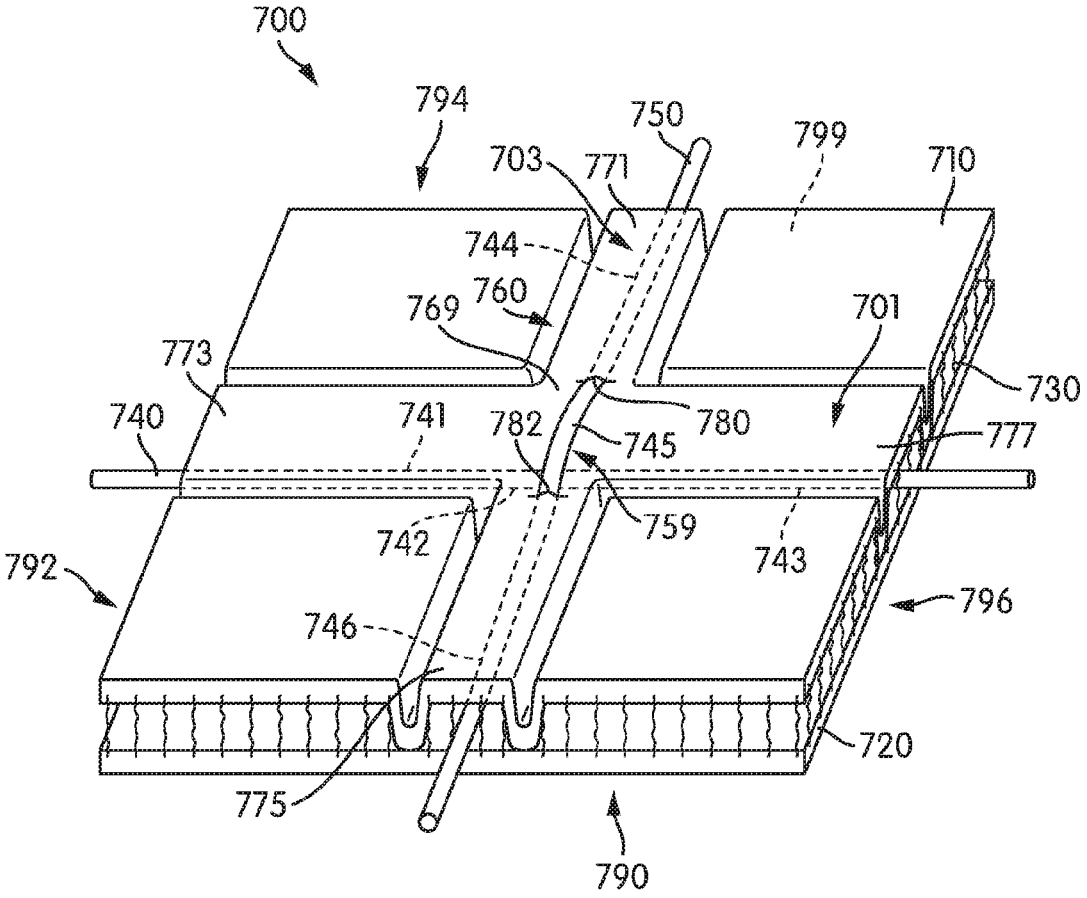
FIG. 7 is a schematic diagram of an embodiment of the spacer textile material having two tensile strand where the tensile strands intersect in at least one location.

FIG. 7 illustrates another embodiment for a spacer textile material. In the embodiment shown in FIG. 7, first tensile strand 740 and second tensile strand 750 may be disposed between first layer 710 and second layer 720 of a spacer textile material 700. Further, spacer textile material 700 may include a plurality of connecting members 730 that extend between and join first layer 710 and second layer 720. Spacer textile material 700 also may have four edges, first edge 790, second edge 792, third edge 794 and fourth edge 796, which are also edges of first layer 710 and second layer 720.

Spacer textile material 700 may include first channel 701 and second channel 703 that may be defined by plurality of welds 760. In some embodiments, first channel 701 and second channel 703 intersect at connecting portion 769. In particular, first channel 701 may include first portion 773 and second portion 777 that join with first portion 771 and second portion 775 of second channel 703 at connecting portion 769.

In some embodiments, first tensile strand 740 and second tensile strand 750 intersect, or overlap, at intersection region 759. In some embodiments, first tensile strand 740 includes first portion 741, second portion 742 and third portion 743 that extend through first portion 773 of first channel 701, connecting portion 769 and second portion 777 of first channel 701, respectively. In particular, second portion 742 of first tensile strand 740 may be disposed within connecting portion 769. In some embodiments, second portion 742 is disposed between first layer 710 and second layer 720. Second tensile strand 750 includes first portion 744, second portion 745 and third portion 746 that extend through first portion 771 of second channel 703, connecting portion 769 and second portion 775 of second channel 703, respectively. Moreover, second portion 745 of second tensile strand 750 extends between first opening 780 and second opening 782 of first layer 710. In particular, second portion 745 may extend along an outer face 799 of first layer 710.

In this configuration, first tensile strand 740 and second tensile strand 750 overlap with one another, but do not come into direct contact. Instead, first layer 710 is disposed between the overlapping portions of first tensile strand 740 and second tensile strand 750. Specifically, first layer 710 is disposed between second portion 745 of second tensile strand 750 and second portion 742 of first tensile strand 740. With this arrangement, second portion 745 of second tensile strand 750 may be configured to interact with additional components associated with spacer mesh material 700. In some embodiments, this arrangement may also reduce any tendency for the movement of second tensile strand 750 to interfere with the movement of first tensile strand 740.

In other embodiments, tensile strands can be arranged so that there are multiple intersection regions between two or more tensile strands. For example, if a first tensile strand is arranged with two portions adjacent to one another, a second tensile strand could be configured to cross over the first tensile strand at two different locations. Various possible configurations are discussed below and shown in FIGS. 8 through 11, however, it will be understood that still other arrangements are possible.

Figure 8:
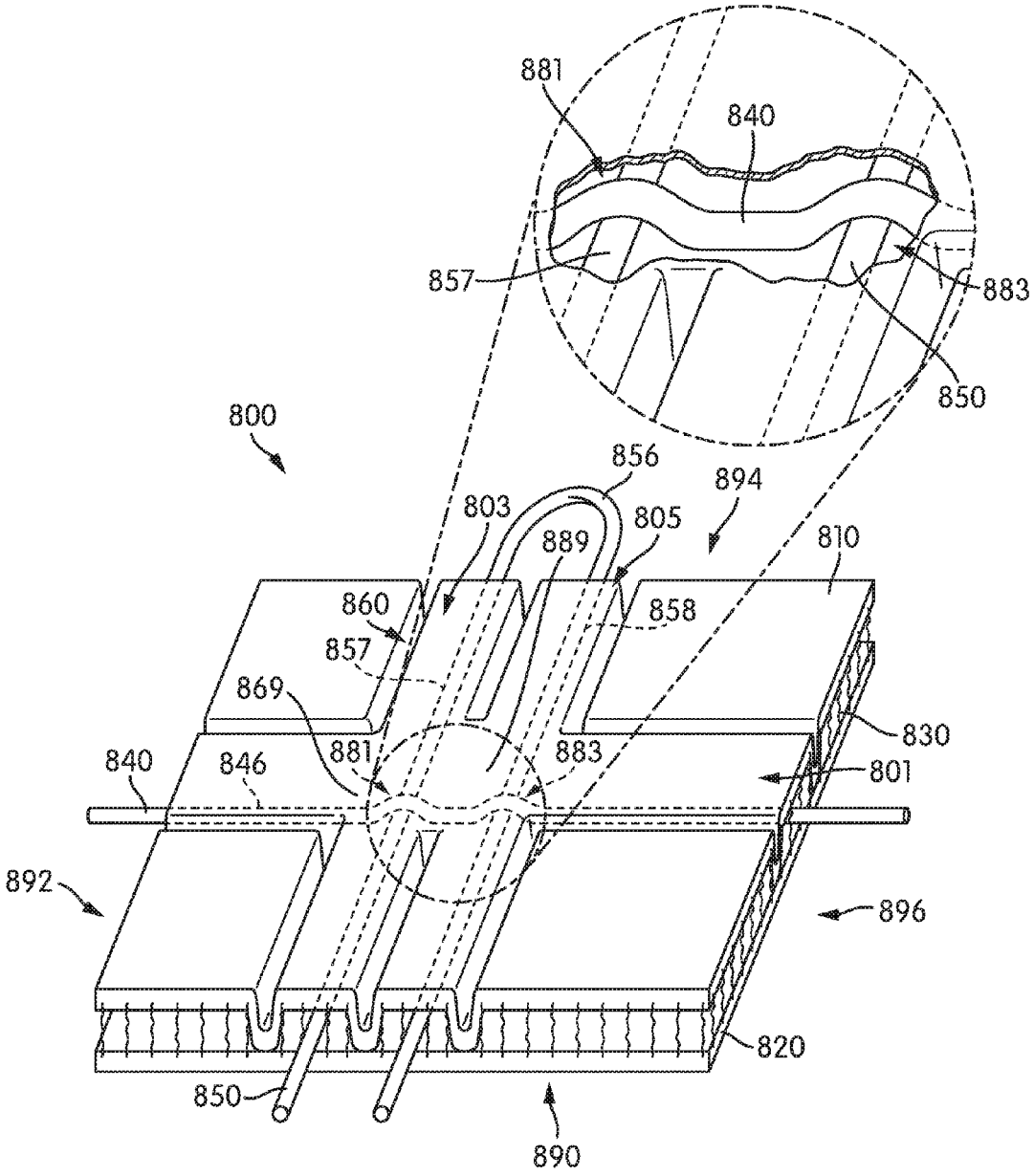
FIG. 8 is a schematic diagram of an embodiment of the spacer textile material having a tensile strand where the tensile strands intersect in at least two locations.

FIG. 8 illustrates another possible configuration for a spacer mesh 800 with a plurality of tensile strands, including a first tensile strand 840 and a second tensile strand 850. Referring to FIG. 8, portions of first tensile strand 840 and second tensile strand 850 may be disposed between first layer 810 and second layer 820 of a spacer textile material 800. Further, spacer textile material 800 may include a plurality of connecting members 830 that extend between and join first layer 810 and second layer 820. Spacer textile material 800 also may have four edges, first edge 890, second edge 892, third edge 894 and fourth edge 896, which are also edges of first layer 810 and second layer 820. Portions of first tensile strand 840 and second tensile strand 850 are disposed between first layer 810 and second layer 820 and in the space created between connecting members 830.

Spacer textile material 800 may include first channel 801, second channel 803 and third channel 805 that may be defined by plurality of welds 860. First channel 801 may generally extend from second edge 892 to fourth edge 896, while second channel 803 and third channel 805 may generally extend from first edge 890 to third edge 894. Moreover, in some embodiments, second channel 803 and third channel 805 may be approximately parallel with one another. In other embodiments, however, second channel 803 and third channel 805 may not be parallel.

In some embodiments, first channel 801 and second channel 803 intersect at first connecting portion 869. Additionally, first channel 801 and third channel 805 may intersect at second connecting portion 889. In some embodiments, first connecting portion 869 and second connecting portion 889 may be disposed adjacent to one another. In other embodiments, however, first connecting portion 869 and second connecting portion 889 could be spaced apart by any distance from one another.

As seen in FIG. 8, second tensile strand 850 extends through both second channel 803 and third channel 805. In particular, second tensile strand 850 exits second channel 803 at third edge 894, loops around at an intermediate loop portion 856, and enters back into third channel 805 at third edge 894. This provides a configuration in which second tensile strand 850 includes a first portion 857 that extends through first connecting portion 869 and a second portion 858 that extends through second connecting portion 889.

First tensile strand 840 may be disposed in first channel 801. In some embodiments, first tensile strand 840 may intersect first portion 857 of second tensile strand 850 and second portion 858 of second tensile strand 850 at first intersecting region 881 and second intersecting region 883, respectively. In other words, first tensile strand 840 may intersect second tensile strand 850 at two different locations of second tensile strand 850.

The configuration of the current embodiment shows first tensile strand 840 passing directly over second tensile strand 850. However, in other embodiments, first tensile strand 840 could pass under second tensile strand 850. In still other embodiments, first tensile strand 840 could pass over second tensile strand 850 at first intersection region 881 and under second tensile strand 850 at second intersection region 883, or vice versa.

It is also contemplated that in embodiments incorporating two or more intersecting tensile strands, any possible weaving arrangement may be utilized to achieve desired structural properties for a spacer textile material. For example, some embodiments may use woven arrangements of intersecting tensile strands to create meshes or netted arrangements of tensile strands, such that the movements of intersecting tensile members are not substantially independent. In other embodiments, however, intersections between two or more tensile strands can be selected so that each tensile strand can move independently of other tensile strands.

Figure 9:
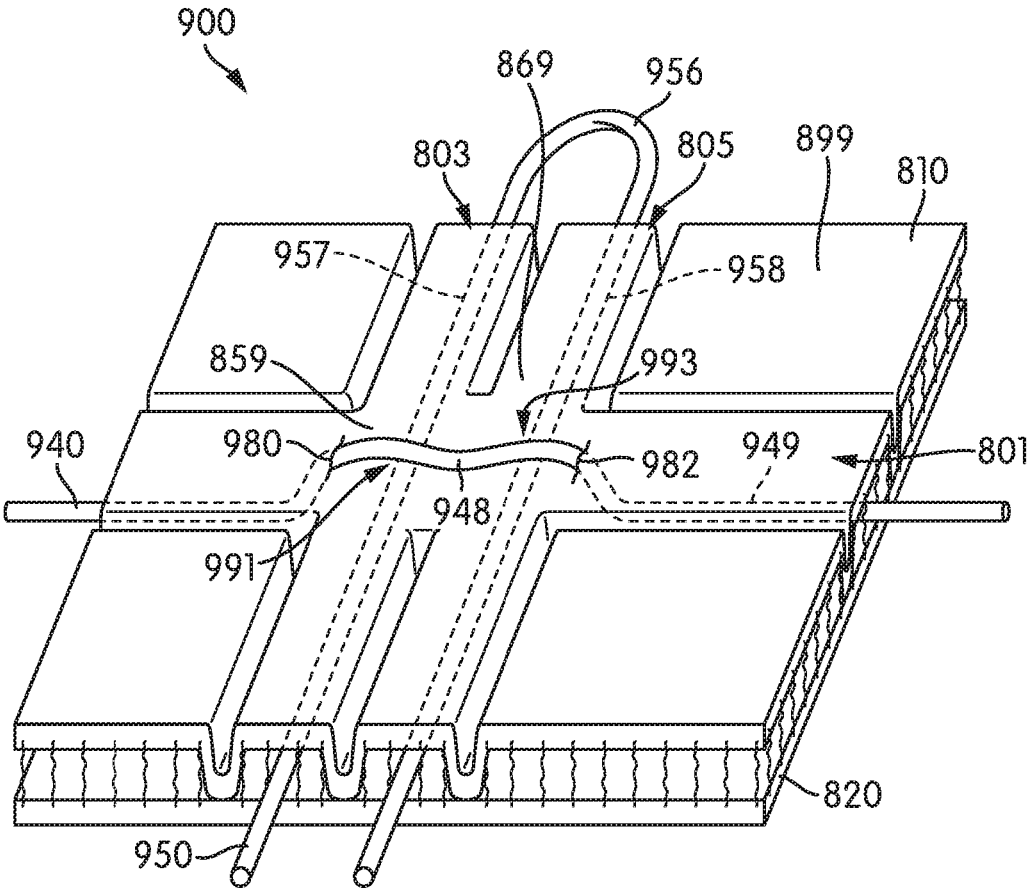
FIG. 9 is a schematic diagram of an embodiment of the spacer textile material having a tensile strand where the tensile strands intersect in at least two locations.
Figure 10:
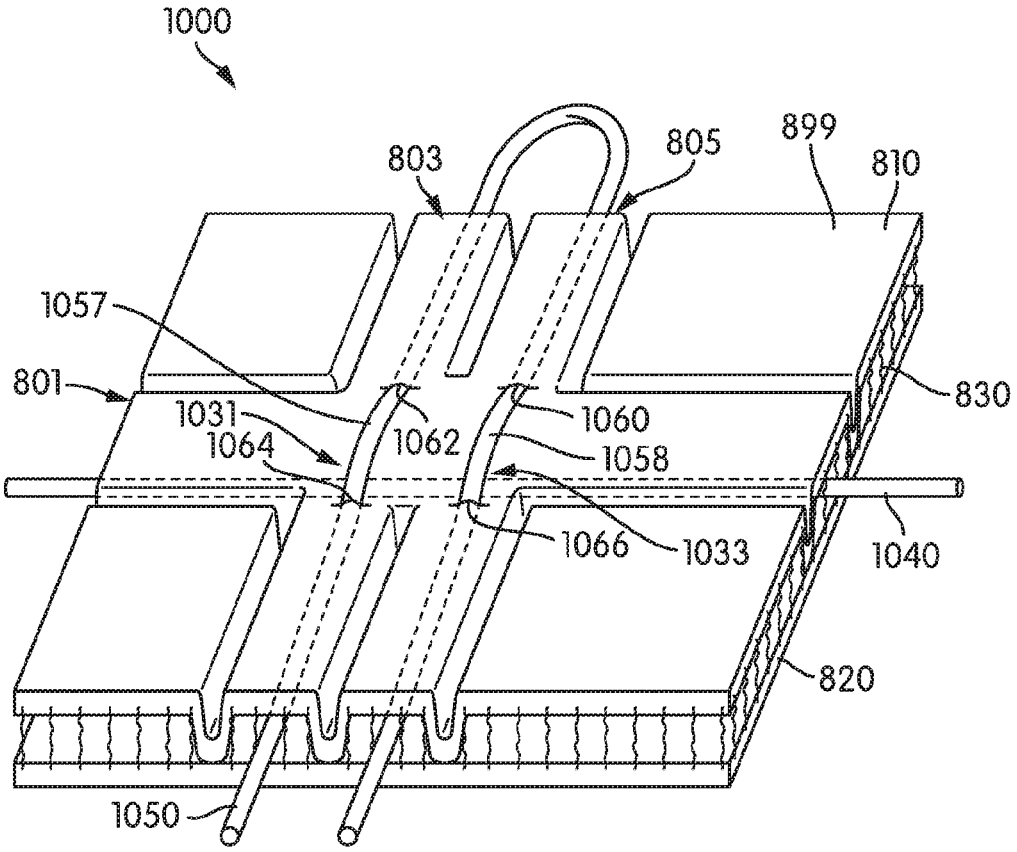
FIG. 10 is a schematic diagram of an embodiment of the spacer textile material having two tensile strands where the tensile strands intersect in at least two locations.
Figure 11:
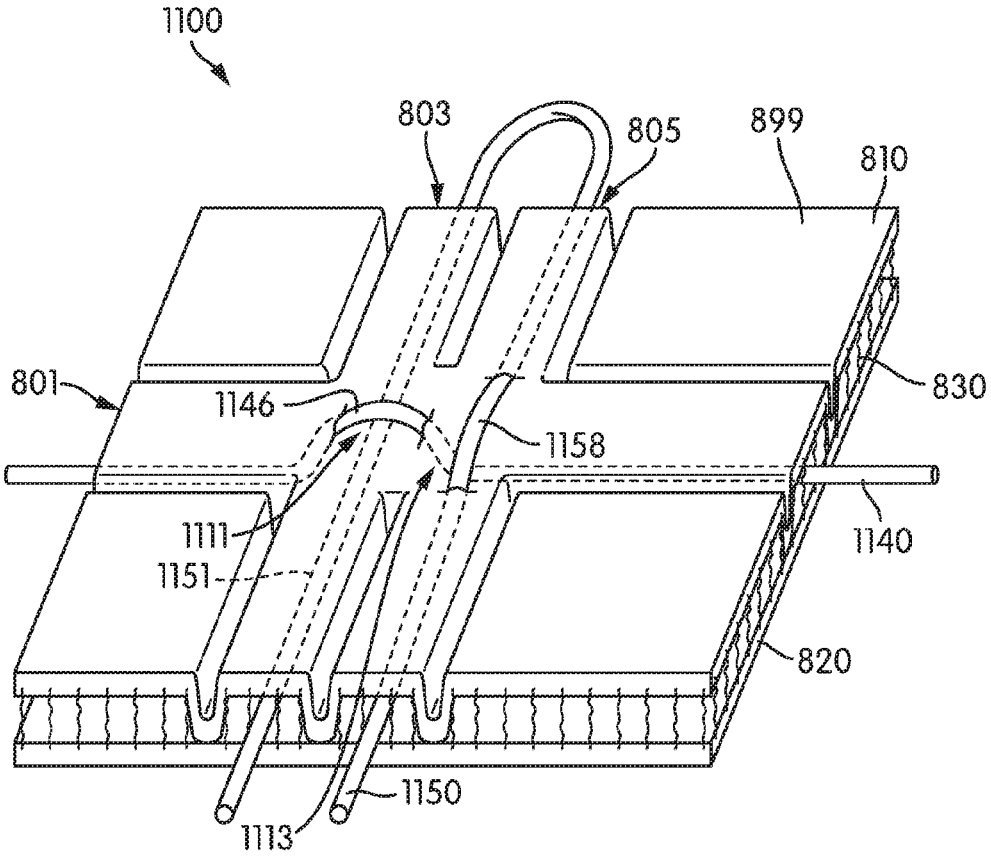
FIG. 11 is a schematic diagram of an embodiment of the spacer textile material having two tensile strands where the tensile strands intersect in at least two locations.

FIGS. 9 through 11 illustrate still further embodiments of a spacer textile material 900 that incorporate different configurations for intersecting tensile strands. The general configuration of the spacer textile materials shown in FIGS. 9 through 11 may substantially similar to spacer textile material 800 discussed above and shown in FIG. 8. Moreover, for purposes of clarity, like numerals are used to designate like parts. It will be understood that each of the different embodiments shown in FIGS. 9 through 11 may share some features with spacer textile material 800, but not others. For example, as seen in FIG. 9, spacer textile material 900 may include a similar arrangement of channels, including first channel 801, second channel 803 and third channel 805. However, each of the embodiments of FIGS. 9 through 11 incorporate variations in the arrangements of tensile strands.

Referring first to FIG. 9, second tensile strand 950 includes a first portion 957 and a second portion 958 that extend through second channel 803 and third channel 805, respectively, as well as an intermediate loop portion 956 extending outwardly from spacer textile material 900. Portions of first tensile strand 940 extend through first channel 801. However, first tensile strand 940 includes an intermediate portion 948 that extends outwardly from first channel 801 at first opening 980 and second opening 982. Thus, intermediate portion 948 extends along outer face 899 of first layer 810. In particular, intermediate portion 948 overlaps with first portion 957 and second portion 958 of second tensile strand 950 at first intersection region 991 and second intersection region 993, respectively. However, intermediate portion 948 does not contact first portion 957 or second portion 958 as intermediate portion 948 is disposed outwardly from first connecting portion 859 and second connecting portion 869.

In still another embodiment, it may be possible for two adjacent portions of a tensile strand to pass outside of a spacer textile material along various intersection regions. For example, FIG. 10 illustrates a still further embodiment of a spacer textile material 1000 where second tensile strand 1050 includes a first intermediate portion 1057 and a second intermediate portion 1058 that exit first layer 810 at a first intersection region 1031 and a second intersection region 1033, respectively. In particular, first intermediate portion 1057 of second tensile strand 1050 extends along outer face 899 of first layer 810 from first opening 1062 and second opening 1064, thereby passing over first tensile strand 1040. Likewise, second intermediate portion 1058 of second tensile strand 1050 extends along outer face 899 of first layer 810 from third opening 1060 and fourth opening 1066, thereby passing over first tensile strand 1040.

In still another arrangement for a spacer textile material 1100, shown in FIG. 11, a first portion 1146 of a first tensile strand 1140 extends along outer face 899 at first intersection region 1111, thereby passing over first portion 1151 of second tensile strand 1150. Additionally, a second portion 1158 of second tensile strand 1150 extends along outer face 899 at second intersection region 1113, thereby passing over first tensile strand 1140 at second intersection region 1113. In other words, the configuration shown in FIG. 11 is a woven configuration in which first tensile strand 1140 passes over second tensile strand 1150 and then under second tensile strand 1150.

Although the embodiments shown in the Figures include two tensile strands that intersect one another, still other embodiments could include three or more different tensile strands that are configured to intersect one another. Moreover, as discussed above, some embodiments could include a plurality of tensile strands (i.e., two, three, four or more tensile strands) that intersect one another in a variety of different patterns including grid-like patterns, truss-like patterns as well as possibly other kinds of patterns. The type of pattern used, and thus the number of intersections between various different tensile strands, can be selected according to factors including desired tensile strength, desired mesh spacing, manufacturing considerations as well as possibly other factors.

The above described spacer textile material may be incorporated into at least a portion of an article of footwear. The spacer textile material may be incorporated into at least a portion of an upper for an article of footwear. When incorporated into the upper, the spacer textile material may have any number of tensile strands. In some embodiments, portion of at least two tensile strands may intersect or overlap.

Figure 12:
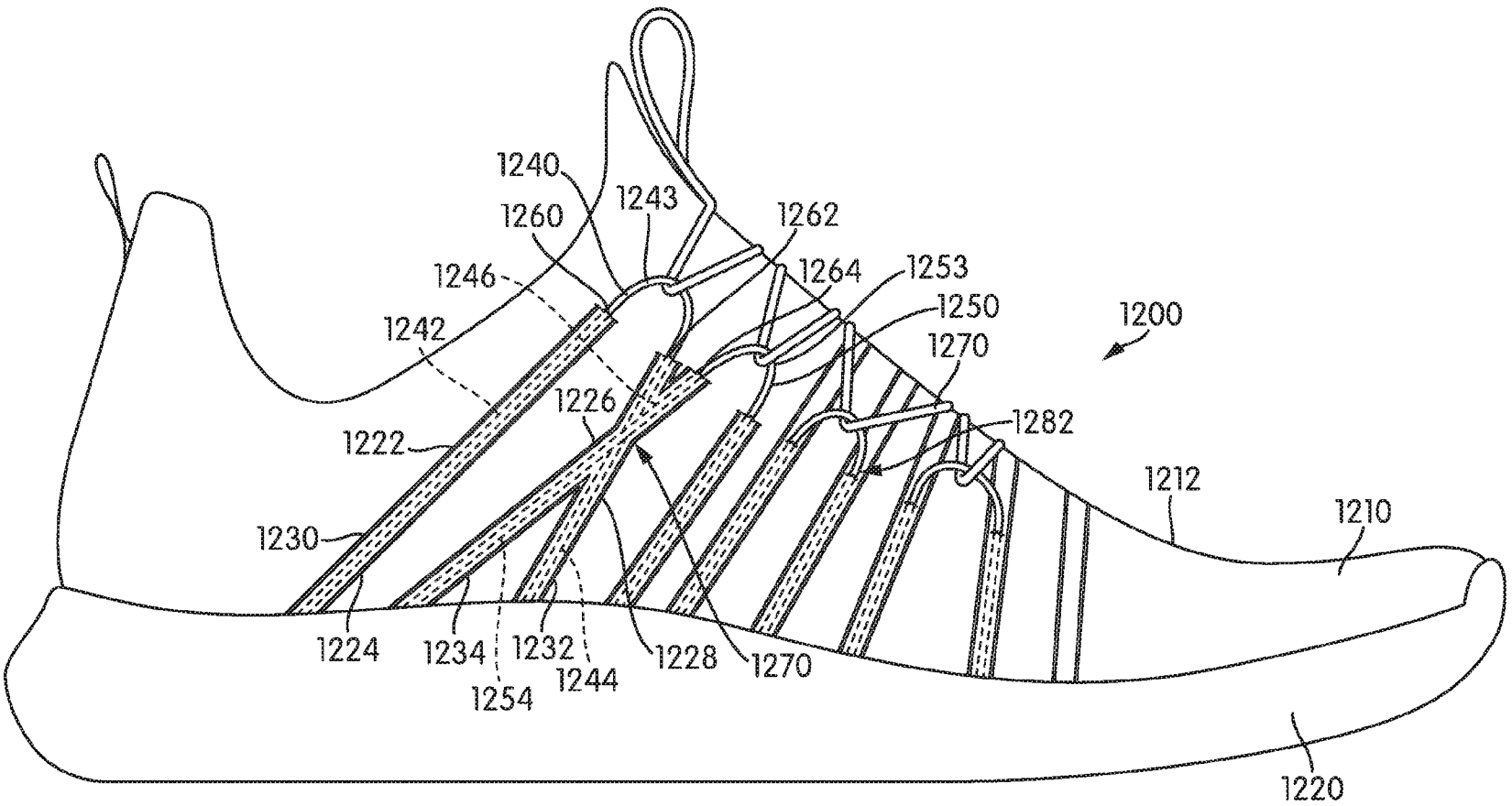
FIG. 12 is a schematic diagram of an embodiment of an article of footwear incorporating a spacer textile material having tensile strands arranged in portion of the upper of the article of footwear, where at least two tensile strands intersect.

The tensile strands of the spacer textile material incorporated into a shoe upper may intersect in any location on the spacer textile material. An embodiment, as shown in FIG. 12, includes portions of at least two tensile strands that intersect or overlap. Although FIG. 12 illustrates a particular arrangement for two intersecting tensile strands that intersect within channels of the spacer textile material, other embodiments may include any other kinds of intersection configurations, including any of the various types of intersection configurations of the above described embodiments.

The tensile strands shown in article of footwear 1200 depicted in FIG. 12 may be disposed in spacer textile material 1210 incorporated into shoe upper 1212. As shown in FIG. 12, spacer textile material 1210 may include multiple welds that define multiple channels. More specifically, first weld 1222 and second weld 1224 define first channel 1230. Similarly, third weld 1226 and fourth weld 1228 define second channel 1232. First portion 1242 of tensile strand 1240 may be disposed in first channel 1230 between a first layer and second layer of spacer textile material 1210.

Further, in some embodiments, first portion 1242 may extend from sole structure 1220 within first channel 1230 to first opening 1260 disposed on the outer surface of the spacer textile material 1210. Tensile strand 1240 may extend from spacer textile material 1210 through first opening 1260. Second portion 1243 of tensile strand 1240 may form a loop on the exterior of spacer textile material 1210. Second portion 1243 may be disposed between first opening 1260 and second opening 1262.

In some embodiments, third portion 1244 of tensile strand 1240 may be further disposed in the spacer textile material through second opening 1262. Third portion 1244 may extend from second opening 1262 within second channel 1232 to sole structure 1220.

In addition, spacer textile material 1210 may include third channel 1234. In some embodiments, third channel 1234 and second channel 1232 may intersect at intersection region 1270. A first portion 1254 of a second tensile strand 1250 may be disposed in third channel 1234 between the first layer and second layer of spacer textile material 1210. First portion 1254 of channel 1234 may extend between sole structure 1220 and third opening 1264.

As stated above, second channel 1232 and third channel 1234 may intersect at intersection 1270. In addition, third portion 1244 of first tensile strand 1240 and first portion 1254 of second tensile strand may also intersect or overlap at intersection region 1270. The intersection of portions of the tensile strands may be similar to the intersection depicted in FIG. 6.

The intersection of portions of two or more tensile strands may provide additional support to the upper in the selected locations. Accordingly, any number of intersections may be disposed about the upper. Each intersection may be selectively located to provide the support necessary to the specific location. In some cases, the use of tensile strands to provide additional support may provide for a lighter shoe.

In some embodiments, tensile strands also may extend at least partially around lace apertures or act as lace apertures themselves. As such, a tensile strand may extend (a) upward from lower region of the upper or from the sole structure to a lace region, (b) exit and reenter the spacer textile materials forming a loop in the lace region, and (c) travels downward from lace region to the lower region of the upper or the sole structure. In this manner, the loops formed from the tensile strands effectively are lace apertures. A shoe lace may be laced through the tensile strand loops.

As shown in FIG. 12, a portion of each tensile strand may be disposed on the outer face or surface of spacer textile material 1210. In some embodiments, this exposed portion of each tensile strand may be a loop that may be utilized as a shoe lace eyelet. In some embodiments, a shoe lace may be inserted through multiple loops formed on upper 1212. For example, second portion 1243 of first tensile strand 1240 together with second portion 1253 of second tensile strand 1250 form adjacent loops on the exterior of spacer textile material 1210. These loops may act as eyelets to receive the shoe lace 1270.

When shoe lace 1270 is tightened, first tensile strand 1240 and second tensile strand 1250 are also tightened, or in other words, placed under an increased tension. In a similar manner, the remaining tensile strands of plurality of tensile strands 1282 may be tightened as shoe lace 1270 is tightened. The tightened tensile strands may provide better support and a better fit for the wearer of the shoe in the particular area that tensile strands are disposed about spacer textile material 1210. This arrangement has the advantage of tightening the upper around the foot and further (a) limiting excess movement of the foot relative to the sole structure and the upper, and (b) ensuring that the foot remains properly positioned relative to the sole structure and the upper.

In some embodiments, each tensile strand may have the same stretch and flexibility. In other embodiments, each tensile strand may have different flexibility or stretch. Accordingly, a tensile strand may be selectively disposed in or about the spacer textile material in specific locations to provide specific support. For instance, a tensile strand having less flexibility or stretch may be located in or about the spacer textile material of the upper in an area that requires more support. Further, a tensile strand having greater flexibility or stretch may be located in or about the spacer textile material of the upper in an area that requires more flex and stretch during use. Therefore, an upper may include multiple tensile strands with varying degrees of stretch and flex. The stretch and flex of each tensile strand will depend on its location on a particular upper.

FIG. 12 depicts an article of footwear comprising an upper having a spacer textile material that includes multiple tensile strands, where portions of at least two tensile strands intersect. However, it will be understood that the disclosure is not limited to the particular pattern depicted in FIG. 12. Any of the various patterns, or any combination of patterns, described above may be incorporated into a similar article of footwear as well as possibly other articles and other kinds of apparel.

During activities that involve walking, running, or other ambulatory movements (e.g., cutting, braking), a foot within the shoes described above may tend to stretch the upper component of the shoe. That is, many of the material elements forming the upper (e.g., spacer textile material layers) may stretch when placed in tension by movements of the foot. Although the tensile strands or individual segments of the tensile strands may also stretch, the tensile strand generally stretches to a lesser degree than the other material elements forming the upper. The various segments of the tensile strands may be located, therefore, to form structural components in the upper that (a) resist stretching in specific directions or locations, (b) limit excess movement of the foot relative to the sole structure and the upper, (c) ensure that the foot remains properly positioned relative to the sole structure and the upper, and (d) reinforce locations where forces are concentrated.

In addition, the welds forming the channels of the spacer textile material may also form structural components in the upper. The welds, a fusion of the first layer to the second layer of the spacer textile material, may also assist the upper to (a) resist stretching in specific directions or locations, (b) limit excess movement of the foot relative to the sole structure and the upper, (c) ensure that the foot remains properly positioned relative to the sole structure and the upper, and (d) reinforce locations where forces are concentrated.

Based upon the above discussion, each of spacer textile material having tensile strands may have various configurations. Although each of these configurations are discussed separately, many of the concepts presented above may be combined to impart specific properties or otherwise ensure that spacer textile material having tensile strands are optimized for a particular purpose or product.

In still other embodiments, a spacer textile material including tensile strands arranged in various configurations may incorporated into various kinds of articles including, but are not limited to: hiking boots, soccer shoes, football shoes, sneakers, running shoes, cross-training shoes, rugby shoes, basketball shoes, baseball shoes as well as other kinds of shoes. Moreover, in some embodiments, a spacer textile material may be incorporated into various kinds of non-sports related footwear, including, but not limited to: slippers, sandals, high heeled footwear, loafers as well as any other kinds of footwear.

The spacer textile material could also be incorporated into various kinds of articles of apparel and/or sporting equipment (e.g., gloves, helmets, etc.). In some embodiments, the article may include one or more articulated portions that are configured to move. In other cases, the article may be configured to conform to portions of a wearer in a three-dimensional manner. Examples of articles that are configured to be worn include, but are not limited to: footwear, gloves, shirts, pants, socks, scarves, hats, jackets, as well as other articles. Other examples of articles include, but are not limited to: protective equipment such as shin guards, knee pads, elbow pads, shoulder pads, as well as any other type of protective equipment. Additionally, in some embodiments, the article could be another type of article including, but not limited to: bags, purses, backpacks, as well as other articles that may or may not be worn.

While various embodiments of the disclosure have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

What is claimed is:

1. A spacer textile material comprising:

a first layer;

a second layer;

a plurality of connecting members extending between and joining the first layer and the second layer;

a first tensile strand and a second tensile strand;

a first channel including a first channel portion and a second channel portion;

a second channel including a third channel portion and a fourth channel portion;

a third channel including a fifth channel portion and a sixth channel portion;

the first channel portion bounded by a first plurality of welds, the first plurality of welds including portions of the first layer and the second layer that are in direct contact;

the second channel portion bounded by a second plurality of welds, the second plurality of welds including portions of the first layer and the second layer that are in direct contact;

the third channel portion bounded by a third plurality of welds, the third plurality of welds including portions of the first layer and the second layer that are in direct contact;

the fifth channel portion bounded by a fourth plurality of welds, the fourth plurality of welds including portions of the first layer and the second layer that are in direct contact;

wherein a portion of the first tensile strand is disposed between the first layer and the second layer in the first channel;

wherein a first portion of the second tensile strand is disposed between the first layer and the second layer in the second channel;

wherein a second portion of the second tensile strand is disposed between the first layer and the second layer in the third channel;

wherein the first tensile strand intersects the first portion of the second tensile strand at a first intersection region, the first intersection region defined by the first plurality of welds and the third plurality of welds; and wherein the first tensile strand intersects the second portion of the second tensile strand at a second intersection region, the second intersection region defined by the second plurality of welds and the fourth plurality of welds.

2. The spacer textile material according to claim 1, wherein the first tensile strand, the first portion of the second tensile strand and the second portion of the second tensile strand are disposed between the first layer and the second layer in the first intersection region and the second intersection region.

3. The spacer textile material according to claim 2, wherein a third portion of the second tensile strand extends between the third channel portion and the fifth channel portion along an edge of the spacer textile material.

4. The spacer textile material according to claim 3, wherein the third portion of the second tensile strand forms a loop between the third channel portion and the fifth channel portion.

5. The spacer textile material according to claim 1, wherein the first intersection region is associated with a first connecting portion that joins the first channel and the second channel and the second intersection region is associated with a second connecting portion that joins the first channel and the third channel.

6. The spacer textile material according to claim 2, wherein the first tensile strand contacts the second tensile strand in the first intersection region and the second intersection region.

7. An article of footwear comprising:

an upper and a sole structure, wherein at least a portion of the upper comprises:

a spacer textile material comprising:

a first layer;

a second layer;

a first tensile strand and a second tensile strand;

a first channel bounded by a first plurality of welds including portions of the first layer and the second layer that are in direct contact;

a second channel bounded by a second plurality of welds including portions of the first layer and the second layer that are in direct contact;

a third channel bounded by a third plurality of welds including portions of the first layer and the second layer that are in direct contact;

wherein a first portion of the first tensile strand is disposed in the first channel;

wherein a second portion of the first tensile strand is disposed in the second channel;

wherein the second tensile strand is disposed in the third channel;

wherein the second portion of the first tensile strand intersects the second tensile strand at an intersection region;

wherein the second channel and the third channel intersect at the intersection region; and wherein the intersection region is defined by the first plurality of welds and the second plurality of welds and the third plurality of welds.

8. The article of footwear according to claim 7, wherein the second portion of the first tensile strand and the second tensile strand are disposed between the first layer and the second layer in the intersection region.

9. The article of footwear according to claim 7, wherein a third portion of the first tensile strand extends between the first channel and the second channel along an edge of the spacer textile material.

10. The article of footwear according to claim 9, wherein the third portion of the first tensile strand forms a loop between the first channel and the second channel.

11. The article of footwear according to claim 10, wherein the loop is a lace aperture and a lace may be inserted through the loop.

12. The article of footwear according to claim 7, wherein the first portion of the first tensile strand extends from the sole structure within the first channel.

13. The article of footwear according to claim 12, wherein the second portion of the first tensile strand extends within second channel to the sole structure.

14. The article of footwear according to claim 13, wherein the second tensile strand extends from the sole structure within the third channel.

15. The article of footwear according to claim 7, wherein the first tensile strand is less flexible than the second tensile strand.

16. An article of footwear comprising:

an upper and a sole structure, wherein at least a portion of the upper comprises:

a spacer textile material comprising:

a first layer;

a second layer;

a plurality of connecting members extending between and joining the first layer and the second layer;

a first tensile strand and a second tensile strand;

wherein portions of the first layer are joined to portions of the second layer to define a plurality channels;

wherein the plurality of channels are bounded by a plurality of welds;

wherein at least a portion of the first tensile strand and at least a portion of the second tensile strand are disposed between the first layer and second layer within the plurality of channels;

wherein the first tensile strand and the second tensile strand intersect in an intersection region; and wherein the intersection region is defined by the plurality of welds.

17. The article of footwear according to claim 16, wherein the first tensile strand and the second tensile strand are disposed between the first layer and the second layer in the intersection region.

18. The article of footwear according to claim 16, wherein the first tensile strand intersects the second tensile strand in at least two intersection regions.

19. The article of footwear according to claim 16, wherein the first tensile strand is spaced apart from the second tensile strand in the intersection region.

* * * * *